United States Patent [19]

Chessin et al.

[11] 4,101,388

[45] Jul. 18, 1978

[54] PREVENTION OF ANODE BAG CLOGGING IN NICKEL IRON PLATING

[75] Inventors: Hyman Chessin, West Bloomfield; Edgar J. Seyb, Jr., Berkley, both of Mich.

[73] Assignee: M & T Chemicals Inc., Stamford, Conn.

[21] Appl. No.: 782,898

[22] Filed: Mar. 30, 1977

[51] Int. Cl.[2] ..... C25D 3/12; C25D 3/20; C25D 3/56

[52] U.S. Cl. ..... 204/43 T; 204/48; 204/49

[58] Field of Search ..... 204/43 T, 43 P, 43 N, 204/48, 49, 112, 123

[56] References Cited

U.S. PATENT DOCUMENTS 3,506,547 4/1970 Ambrosia et al. ..... 204/43 T

*Primary Examiner*—G. L. Kaplan

*Attorney, Agent, or Firm*—Kenneth G. Wheeless; Robert Spector

[57] ABSTRACT

This invention relates to a process and composition for the preparation of an electrodeposit which contains at least one metal selected from the group consisting of nickel, cobalt and iron, which comprises passing current from an anode to a cathode through an aqueous plating solution containing at least one member selected from the group consisting of cobalt compounds and nickel compounds and iron compounds to provide cobalt, nickel and ferrous ions for electrodepositing cobalt, nickel, nickel-cobalt alloys, nickel-iron alloys, or nickel-cobalt-iron alloys the improvement comprising the presence of an effective amount of at least one compound or salt which in solution yields at least one member selected from the group consisting of cations of lanthanum, cerium, praseodymium, neodymium, promethium, samarium, europium, gadolinium, terbium, dysprosium, holmium, erbium, thulium, ytterbium, and lutetium in the said baths in a single or combined concentration of 0.1 gram per liter to 20 grams per liter.

12 Claims, No Drawings

PREVENTION OF ANODE BAG CLOGGING IN NICKEL IRON PLATING

This invention relates to improved processes and compositions for the electrodeposition of nickel and iron alloys with nickel or nickel-cobalt. More particularly, this invention relates to the use of new additives to prevent the clogging of anode bags in the plating of iron-containing alloys of nickel, and nickel-cobalt.

BACKGROUND OF THE INVENTION

Certain plating baths, in particular nickel and nickel-iron or other nickel alloy plating baths, will contain as additives organic materials. In many cases organics are complexers or reducers and as part of the reactions in the electrolytic baths, these organic compounds will decompose and/or react. A common decomposition or reaction product is the oxalate ion. The oxalate ion may be formed as a result of direct electrolytic decomposition or even of decomposition resulting from the presence of oxygen (or other oxidizers) formed at the anodes or introduced by air agitation. It is commonly formed in baths containing citric, malic, glutaric, gluconic, ascorbic, isoascorbic, muconic, glutamic, glycollic, aspartic, glucose, fructose, sucrose, dextrose, gluconate, ascorbate, erythorbate, other carbohydrates and the like.

As a result of the formation of the oxalate ion (however formed in the bath) a precipitate of insoluble nickel oxalate has been forming in these baths and, in particular, this precipitate (which may contain other occulded or absorbed materials such as carbonaceous materials or insoluble sulfides) has been forming in and about the anode bag cloth material. Eventually these anode bags become both hardened and clogged with this material so that flow of the electrolytic solution is impeded. When the process has proceeded far enough, it becomes necessary to remove the old bags and replace them with new ones, an expensive operation.

There are, in general, two ways that the insolubilizing cation can be introduced to the plating bath:

1. The cation could be added in the form of a soluble salt, e.g., as cerous chlorides. In such case beneficial actions may be obtained by general precipitation of the oxalate (i.e., cerium oxalate) in a form which does not clog the anode bags even though some is formed therein and by the fact that this other oxalate does not form the hardened matrix layer now formed by nickel oxalate. Of course, the precipitate must not deteriorate the electrodeposit.
2. The cation could be introduced as part of a sparingly soluble salt and preferably before a filter element. In parallel to the case above, cerous fluoride may be added. In these cases locally higher concentrations of the sparingly soluble salt would cause exchange of the anions i.e. the sulfate or fluoride ion for the oxalate ion and so the general concentration of the oxalate in the body of the electrolyte would be kept low enough to prevent precipitation of nickel oxalate in the anode bags.

DETAILED DESCRIPTION

In accordance with certain of its aspects, this invention relates to processes for the prevention of anode bag clogging in the preparation of an electrodeposit which contains nickel and alloys thereof which comprises passing current from an anode to a cathode through an aqueous acidic plating solution containing nickel compounds, oxalic acid and precursors and derivatives thereof for electrodepositing nickel or alloys thereof, the improvement comprising the addition of one compound or salt which in solution yields a cation of at least one member selected from the group consisting of cations of lanthanum, cerium, praseodymium, neodymium, promethium, samarium, europium, gadolinium, terbium, dysprosium, holmium, erbium, thulium, ytterbium, and lutetium in the said baths in a single or combined concentration of 0.1 gram per liter to 20 grams per liter.

The useful cations come from Group III B including the rare earths or mixtures thereof. Cerium oxalate has a solubility given as $4.1\times10^{-5}$ at 25° C and dysprosium is even more insoluble. Obviously cheaper mixtures, (e.g. misch metal) containing these metals are useful.

The invention consists of the introduction of a cation of low oxalate solubility, primarily cerium and the other rare earths or mixtures thereof, such that nickel oxalate is prevented from depositing in the anode bag cloth or is dissolved therefrom. These more insoluble oxalates may deposit finely in the bath and may be caught on the filter, partially codeposited in the metal or even some may be caught on the anode bag material but in a more open and flexible form than the nickel oxalate.

The baths may contain an effective amount of at least one member selected from the group consisting of:

(a) primary brightener;
(b) secondary brightener;
(c) secondary auxiliary brightener; and
(d) anti-pitting agent.

The substrates on which the nickel-containing, cobalt-containing, nickel-cobalt-containing, nickel-iron-containing or nickel-cobalt-iron containing electrodeposits of this invention may be applied, may be metal or metal alloys such as are commonly electrodeposited and used in the art of electroplating such as nickel, cobalt, nickel-cobalt, copper, tin, brass, etc. Other typical substrate basis metals from which articles to be plated are manufactured may include ferrous metals such as steel; copper; tin and alloys thereof such as with lead; alloys of copper such as brass, bronze, etc.; zinc, particularly in the form of zinc-base die castings; all of which may bear plates of other metals, such as copper, etc. Basis metal substrates may have a variety of surface finishes depending on the final appearance desired, which in turn depends on such factors as luster, brilliance, leveling, thickness, etc. of the cobalt, nickel, or iron containing electroplate applied on such substrates.

The term "primary brightener" as used herein is meant to include plating additive compounds such as reaction products of epoxides with alpha-hydroxy acetylenic alcohols such as diethoxylated 2 butyne-1,4-diol or dipropoxylated 2 butyne-1,4-diol, other acetylenics, N-heterocyclics, active sulfur compounds, dye-stuffs, etc. Specific examples of such plating additives are:

1,4-di-(β-hydroxyethoxy)-2-butyne
1,4-di-(β-hydroxy-γ-chloropropoxy)-2-butyne
1,4-di-(β-γ-epoxypropoxy)-2-butyne
1,4-di-(β-hydroxy-γ-butenoxy)-2-butyne
1,4-di-(2'-hydroxy-4'-oxa-6'-heptenoxy)-2-butyne
N-1,2-dichloropropenyl pyridinium chloride
2,4,6-trimethyl N-propargyl pyridinium bromide
N-allyl quinaldinium bromide
2-butyne-1,4-diol
propargyl alcohol
2-methyl-3-butyn-2-ol thiodiproprionitrile

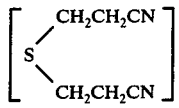

thiourea
phenosafranin
fuchsin

When used alone or in combination, a primary brightener may produce no visual effect on the electrodeposit, or may produce semi-lustrous, fine-grained deposits. However, best results are obtained when primary brighteners are used with either a secondary brightener, a secondary auxiliary brightener, or both, in order to provide optimum deposit luster, rate of brightening, leveling, bright plate current density range, low current density coverage, etc.

The term "secondary brightener" as used herein is meant to include aromatic sulfonates, sulfonamides, sulfonimides, sulfinates, etc. Specific examples of such plating additives are:

1. trisodium 1,3,6-naphthalene trisulfonate
2. sodium benzene monosulfonate
3. dibenzene sulfonimide
4. sodium benzene monosulfinate
5. saccharin Such plating additive compounds, which may be used singly or in suitable combinations, have one or more of the following functions:

1. To obtain semi-lustrous deposits or to produce substantial grain-refinement over the usual dull, matte, grainy, non-reflective deposits from additive free baths.
2. To act as ductilizing agents when used in combination with other additives such as primary brighteners.
3. To control internal stress of deposits, generally by making the stress desirably compressive.
4. To introduce controlled sulfur contents into the electrodeposits to desirably affect chemical reactivity, potential differences in composite coating systems, etc. thereby decreasing corrosion, better protecting the basis metal from corrosion, etc.

The term "secondary auxiliary brightener" as used herein is meant to include aliphatic or aromatic-aliphatic olefinically or acetylenically unsaturated sulfonates, sulfonamides, or sulfonimides, etc. Specific examples of such plating additives are:

1. sodium-3-chloro-2-butene-1-sulfonate
2. sodium $\beta$-styrene sulfonate
3. sodium propargyl sulfonate
4. monoallyl sulfamide ($H_2N-SO_2-NH-CH_2-CH=CH_2$)
5. allyl sulfonamide
6. diallyl sulfamide

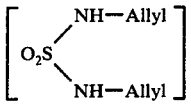

7. sodium allyl sulfonate

Such compounds, which may be used singly (usual) or in combination, have all of the functions given for the secondary brighteners and in addition may have one or more of the following functions:

1. They may act to prevent or minimize pitting (probably acting as hydrogen acceptors).
2. They may cooperate with one or more secondary brighteners and one or more primary brighteners to give much better rates of brightening and leveling than would be possible to attain with any one or any two compounds selected from all three of the classes:
   (1) primary brightener;
   (2) secondary brightener; and
   (3) secondary auxiliary brightener used either alone or in combination.
3. They may condition the cathode surface by catalytic poisoning, etc. so that the rates of consumption of cooperating additives (usually of the primary brightener type) may be substantially reduced, making for better economy of operation and control.

Among the secondary auxiliary brighteners one may also include ions or compounds of certain metals and metalloids such as zinc, cadmium, selenium, etc. which, although they are not generally used at present, have been used to augment deposit luster, etc. Other cooperaing additives of organic nature which may be useful are the hydroxy sulfonate compounds of U.S. Pat. No. 3,697,391, the function of which is to make baths more tolerant to primary brightener concentrations, to increase tolerance toward metallic impurities such as zinc, etc.

The term "anti-pitting agent" as used herein is meant to include a material (different from and in addition to the secondary auxiliary brightener) which functions to prevent or minimize gas pitting. An anti-pitting agent may also function to make the baths more compatible with contaminants such as oil, grease, etc. by their emulsifying, dispersing, solubilizing, etc. action on such contaminants and thereby promote attaining of sounder deposits. Anti-pitting agents are optional additives which may or may not be used in combination with one or more members selected from the group consisting of a primary brightener, a secondary brightener, and a secondary auxiliary brightener. Preferred anti-pitting agents may include sodium lauryl sulfate and sodium lauryl ether sulfate.

Typical nickel-containing, cobalt-containing, and nickel-cobalt-containing bath compositions which may be used in combination with effective amounts of about 0.1 gram per liter to 20 grams per liter of the rare earth compounds and effective amounts of about 0.005–0.2 gram per liter of the primary brighteners, with about 1.0–30 grams per liter of the secondary brightener, and with about 0.5–10 grams per liter of the secondary auxiliary brightener, and with about 0.5–1 gram per liter of anti-pitting agent, described herein are summarized below.

Typical aqueous nickel-containing electroplating baths (which may be used in combination with effective amounts of cooperating additives) include the following wherein all concentrations are in grams per liter (g/l) unless otherwise indicated:

AQUEOUS NICKEL-CONTAINING ELECTROPLATING BATHS

TABLE I

| Component | Minimum | Maximum | Preferred |
|---|---|---|---|
| nickel sulfate | 50 | 500 | 300 |
| nickel chloride | 7.5 | 80 | 45 |
| boric acid | 10 | 55 | 45 |
| pH (electrometric) | 3 | 5 | 4 |

The ratio of nickel ions to iron ions in the foregoing bath is about 1:10 to about 50:1.

A typical sulfamate-type nickel plating bath which may be used in practice of this invention may include the following components:

TABLE II

| Component | Minimum | Maximum | Preferred |
|---|---|---|---|
| nickel sulfamate | 50 | 400 | 375 |
| nickel chloride | 1.5 | 60 | 45 |
| boric acid | 10 | 55 | 45 |
| pH (electrometric) | 3 | 5 | 4 |

The ratio of nickel ions to iron ions in the foregoing bath is about 1:10 to about 50:1.

A typical chloride-free sulfate-type nickel plating bath which may be used in practice of this invention may include the following components:

TABLE III

| Component | Minimum | Maximum | Preferred |
|---|---|---|---|
| nickel sulfate | 50 | 500 | 400 |
| boric acid | 10 | 55 | 45 |
| pH (electrometric) | 2.5 | 4 | 3.-3.5 |

A typical chloride-free sulfamate-type nickel plating bath which may be used in practice of this invention may include the following components:

TABLE IV

| Component | Minimum | Maximum | Preferred |
|---|---|---|---|
| nickel sulfamate | 50 | 400 | 350 |
| boric acid | 10 | 55 | 45 |
| pH (electrometric) | 2.5 | 4 | 3.-3.5 |

The ratio of nickel ions to iron ions in the foregoing bath is about 1:10 to about 50:1.

It will be apparent that the above baths may contain compounds in amounts falling outside the preferred minimum and maximum set forth, but most satisfactory and economical operation may normally be effected when the compounds are present in the baths in the amounts indicated. A particular advantage of the chloride-free baths of Tables III and IV, supra, is that the deposits obtained may be substantially free of tensile stress and may permit high speed plating involving the use of high speed anodes.

The following are aqueous cobalt-containing and cobalt-nickel-containing electroplating baths in which the combination of effective amounts of one or more cooperating additives according to this invention will result in beneficial effects.

AQUEOUS COBALT-CONTAINING AND COBALT-NICKEL-CONTAINING ELECTROPLATING BATHS (All concentrations in g/l unless otherwise noted)

| | | Maximum | Minimum | Preferred |
|---|---|---|---|---|
| V. | Cobalt Bath | | | |
| | $CoSO_4 \cdot 7H_2O$ | 400 | 50 | 300 |
| | $CoCl_2 \cdot 6H_2O$ | 75 | 5 | 60 |
| | $H_3BO_3$ | 50 | 10 | 45 |

-continued

AQUEOUS COBALT-CONTAINING AND COBALT-NICKEL-CONTAINING ELECTROPLATING BATHS (All concentrations in g/l unless otherwise noted)

| | | | | |
|---|---|---|---|---|
| VI. | Cobalt Bath | | | |
| | $CoSO_4 \cdot 7H_2O$ | 500 | 50 | 400 |
| | NaCl | 50 | 5 | 30 |
| | $H_3BO_3$ | 50 | 10 | 45 |
| VII. | High Chloride Cobalt Bath | | | |
| | $CoSO_4 \cdot 7H_2O$ | 350 | 25 | 225 |
| | $CoCl_2 \cdot 6H_2O$ | 350 | 25 | 225 |
| | $H_3BO_3$ | 50 | 10 | 45 |
| VIII. | Cobalt-Nickel Alloy Bath | | | |
| | $NiSO_4 \cdot 7H_2O$ | 400 | 50 | 300 |
| | $CoSO_4 \cdot 7H_2O$ | 225 | 5 | 80 |
| | $NiCl_2 \cdot 6H_2O$ | 75 | 5 | 60 |
| | $H_3BO_3$ | 50 | 10 | 45 |
| IX. | All-Chloride Cobalt Bath | | | |
| | $CoCl_2 \cdot 6H_2O$ | 500 | 50 | 300 |
| | $H_3BO_3$ | 50 | 10 | 45 |
| X. | Sulfamate Cobalt Bath | | | |
| | $Co(O_3SNH_2)_2$ | 400 | 50 | 290 |
| | $CoCl_2 \cdot 6H_2O$ | 75 | 5 | 60 |
| | $H_3BO_3$ | 50 | 10 | 45 |

The ratio of nickel ions to iron ions in the foregoing bath is about 1:10 to about 50:1.

Preferred cobalt-containing bath compositions may contain at least about 30 g/l of $CoCl_2.6H_2O$, and typically 20–50 g/l of $CoCl_2.6H_2O$. Other compounds which have a bath compatible cation (i.e. a cation which does not interfere with the operation of the bath) which will provide at least 7.5 g/l of chloride ion, $Cl^-$(and preferably a minimum of about 9 g/l of $Cl^-$) may also be used.

The pH of all of the foregoing illustrative aqueous nickel-containing, cobalt-containing, nickel-cobalt-containing, and nickel-cobalt-iron-containing compositions may be maintained during plating at pH values of 2.5 to 5.0, and preferably from about 3.0 to 4.0. During bath operation, the pH may normally tend to rise and may be adjusted with acids such as hydrochloric acid or sulfuric acid, etc.

Operating temperature ranges for the above baths may be about 30° to 70° C. with temperatures within the range of 45° to 65° C. preferred.

Agitation of the above baths during plating may consist of solution pumping, moving cathode rod, air agitation or combinations thereof. For applications involving the deposition of alloys containing iron from baths in which the iron is predominantly in the ferrous (divalent) state of valency, it is preferable to use very mild agitation i.e. moving cathode rod, to minimize air oxidation of ferrous to ferric iron.

For plating binary or ternary alloys such as nickel-cobalt, nickel-iron or nickel-cobalt-iron, the anodes may consist of the separate metals involved suitably suspended in the bath as bars, strips or small chunks in titanium baskets. In such cases the ratio of the separate metal anode areas is adjusted to correspond to the particular cathode alloy composition desired. For plating binary or ternary alloys one may also use as anodes alloys of the metals involved in such a percent weight ratio of the separate metals as to correspond to the percent weight ratio of the same metals in the cathode alloy deposits desired. These two types of anode systems will generally result in a fairly constant bath metal ion concentration for the respective metals. If with fixed metal ratio alloy anodes there does occur some bath ion imbalance, occasional adjustments may be made by adding the appropriate corrective concentration of the individual metal salts. All anodes are usually suitably covered with cloth or plastic bags of desired porosity to minimize introduction into the bath of metal particles, anode slime, etc. which may migrate to the cathode either mechanically or electrophoretically to give roughness in cathode deposits.

The following examples are submitted for the purpose of illustration only and are not to be construed as limiting the scope of the invention in any way.

EXAMPLE 1

A nickel electroplating bath composition was prepared by combining in water the following ingredients to provide the indicated concentrations (in g/l unless indicated otherwise).

| | Concentration (g/l) |
|---|---|
| $NiSO_4 . 7H_2O$ | 380 |
| $NiCl_2 \cdot 6H_2O$ | 60 |
| $H_3BO_3$ | 45 |
| ferrous sulfate ($FeSO_4 . 7H_2O$) | 40 |
| Reaction product of Butyne Diol with 2 moles of Ethylene Oxide | 50 mg/l |
| sodium saccharinate (0.6 mole $H_2O$) | 4.0 |
| sodium allyl sulfonate | 2.3 |
| fructose | 20 |
| pH | 3.3 |

A 250 milliliter portion of the above was saturated with oxalic acid, filtered, and the pH adjusted to 4.2. Test tubes were each filled with approximately 20 milliliters of the prepared plating solution. To separate test tubes were added cerium chloride and cerium carbonate. After 85 minutes, all test tubes contained precipitates in the bottom showing that cerium and other rare earths and mixtures thereof precipitate oxalate to reduce the concentration in plating baths and prevent nickel oxalate from clogging anode bags.

EXAMPLE 2

210 ml. of Watt's type nickel plating solution, saturated with oxalate from adding oxalic acid, was placed in each of six beakers and these were placed in a constant temperature water bath at 58° C. After several days, the clear solution was decanted from the nickel oxalate precipitate into another dry beaker and the decantate returned to the water bath. To the 200 ml. of nickel plating solution saturated with oxalate at 58° C was made an addition of:

| | |
|---|---|
| Beaker #1 | Nothing, a control |
| Beaker #2 | 1 g cerous chloride |
| Beaker #3 | 1 g cerous sulfate |
| Beaker #4 | 1 g samarium sulfate |
| Beaker #5 | 1 g neodymium sulfate |
| Beaker #6 | ½ g oxalic acid |

These beakers were stirred occasionally and allowed to equilibrate in the water bath for 18 days. After this time they were examined. All except the #1 control had precipitates on the bottom. #1 beaker was clear indicating no further precipitation of nickel oxalate under these conditions. The other five solutions were filtered through a vacuum filter and the precipitate retained.

In order to test these precipitates for the presence of oxalate:

One drop of 1—1 hydrochloric acid and one drop of a 10% sodium carbonate solution were added to 25 ml. of a 0.5N potassium permanganate solution (15.8 g/l). The addition was made to assure acid conditions and saturation with carbon dioxide. The solution was heated to boiling, then the heat source removed. When a small amount of the precipitate (nickel oxalate) from the Control #6 was added to this solution as soon as gassing from boiling had ceased, effervescence from the release of carbon dioxide (from the oxalate) was observed.

An identical test was run with the precipitates from the other beakers. In each case effervescence of carbon dioxide was obtained thus confirming the presence of the respective oxalate in the precipitates.

Thus this invention has proven that oxalate may be precipitated from plating baths containing nickel by adding rare earth cations, irrespective of the associated anion.

Although this invention has been illustrated by reference to specific embodiments, modifications thereof which are clearly within the scope of the invention will be apparent to those skilled in the art.

What is claimed is:

1. In a process for the preparation of an electrodeposit which contains at least one metal selected from the group consisting of nickel, cobalt and iron, which comprises passing current from an anode to a cathode through an aqueous acidic plating solution containing at least one member selected from the group consisting of nickel compounds, cobalt compounds, and ferrous compounds providing ions for electrodepositing nickel, cobalt, nickel-cobalt alloy, nickel-iron alloy, or nickel-cobalt-iron alloy, and containing an amount of oxalic acid break-down product the improvement comprising the presence of at least one cation selected from the group consisting of cations of lanthanum, cerium, praseodymium, neodymium, promethium, samarium, europium, gadolinium, terbium, dysprosium, holmium, erbium, thulium, ytterbium, and lutetium in single or combined concentration of 0.1 gram per liter to 20 grams per liter.

2. The process of claim 1 wherein said nickel compounds are nickel sulfate and nickel chloride.

3. The process of claim 1 wherein said nickel compounds are nickel sulfamate and nickel chloride.

4. The process of claim 1 wherein said cobalt compounds are cobalt sulfate and cobalt chloride.

5. The process of claim 1 wherein said cobalt compounds are cobalt sulfamate and cobalt chloride.

6. The process of claim 1 wherein said ferrous compound is ferrous sulfate or ferrous chloride.

7. In an aqueous plating solution containing nickel compounds and at least one member selected from the group consisting of cobalt compounds and ferrous compounds, providing ions for electrodepositing nickel, cobalt, nickel-cobalt alloy, nickel-iron alloy, or nickel-cobalt-iron alloy, and containing an amount of oxalic acid break-down product the improvement comprising the presence of at least one cation selected from the group consisting of cations of lanthanum, cerium, praseodymium, neodymium, promethium, samarium, europium, gadolinium, terbium, dysprosium, holmium, erbium, thulium, ytterbium, and lutetium in single or combined concentration of 1.0 gram per liter to 10 grams per liter.

8. The composition as claimed in claim 7 wherein said nickel compounds are nickel sulfate and nickel chloride.

9. The composition as claimed in claim 7 wherein said nickel compounds are nickel sulfamate and nickel chloride.

10. The composition as claimed in claim 7 wherein said cobalt compounds are cobalt sulfate and cobalt chloride.

11. The composition as claimed in claim 7 wherein said cobalt compounds are cobalt sulfamate and cobalt chloride.

12. The composition as claimed in claim 7 wherein said ferrous compound is ferrous sulfate or ferrous chloride.

* * * * *